US007427190B2

(12) United States Patent
Baumgartner

(10) Patent No.: US 7,427,190 B2
(45) Date of Patent: Sep. 23, 2008

(54) HYDRAULIC DEVICE FOR PUMPING MOLTEN METAL AND/OR CONTROLLING A MOLTEN METAL FLOW

(75) Inventor: Heinrich Georg Baumgartner, Schiltach (DE)

(73) Assignee: BBS-Riva S.p.A., Ruina (IT)

( * ) Notice: Subject to any disclaimer, the term of this patent is extended or adjusted under 35 U.S.C. 154(b) by 389 days.

(21) Appl. No.: 10/497,562

(22) PCT Filed: Dec. 18, 2002

(86) PCT No.: PCT/EP02/14495

§ 371 (c)(1),
(2), (4) Date: Jun. 3, 2004

(87) PCT Pub. No.: WO03/055626

PCT Pub. Date: Jul. 10, 2003

(65) Prior Publication Data

US 2005/0069438 A1 Mar. 31, 2005

(30) Foreign Application Priority Data

Dec. 28, 2001 (IT) ..... PD2001A0302

(51) Int. Cl.

| | |
|---|---|
| ***F04B 7/02*** | (2006.01) |
| ***F01B 31/08*** | (2006.01) |
| ***B22D 41/08*** | (2006.01) |
| ***C21C 5/42*** | (2006.01) |

(52) U.S. Cl. ..... 417/507; 92/176; 222/594; 266/239

(58) Field of Classification Search ..... 266/239; 222/595, 594; 92/176, 222, 170.1, 171.1; 417/507

See application file for complete search history.

(56) References Cited

U.S. PATENT DOCUMENTS

| | | | | |
|---|---|---|---|---|
| 2,835,005 | A * | 5/1958 | Green | 222/385 |
| 3,800,986 | A * | 4/1974 | Stamp | 222/593 |
| 6,273,308 | B1 * | 8/2001 | Choshi | 222/596 |
| 2003/0010466 | A1 * | 1/2003 | Sample et al. | 164/113 |

FOREIGN PATENT DOCUMENTS

| | | |
|---|---|---|
| DE | 196 41 252 | 4/1998 |
| EP | 0 053 510 | 6/1982 |
| EP | 0 936 010 | 8/1999 |
| JP | 55-088972 | 7/1980 |
| JP | 05-038564 | 2/1993 |
| JP | 05-039775 | 2/1993 |
| JP | 07-256428 | 10/1995 |
| WO | 02 085560 | 10/2002 |

* cited by examiner

*Primary Examiner*—Devon Kramer
*Assistant Examiner*—Jessica L Frantz
(74) *Attorney, Agent, or Firm*—Greer, Burns & Crain, Ltd.

(57) ABSTRACT

A hydraulic device for pumping molten metal and/or controlling its flow, comprising an enclosure that forms internally a cylindrical chamber, for the connection of at least one first duct and one second duct for the passage of molten metal, within which a piston can slide hermetically in order to pump and/or control flow, an insulating cushion of inert gas being interposed between the piston and the molten metal, the piston being associated with an actuator for moving it with a reciprocating rectilinear motion.

4 Claims, 4 Drawing Sheets

HYDRAULIC DEVICE FOR PUMPING MOLTEN METAL AND/OR CONTROLLING A MOLTEN METAL FLOW

The present invention relates to a hydraulic device for pumping molten metal and/or controlling its flow.

BACKGROUND OF THE INVENTION

The invention is particularly suitable for systems for forming metal castings, in which the molten metal has to be transferred from the holding furnace to the dies substantially with a pouring operation rather than through ducts.

It is known in the art that molten metals are difficult to transfer among the various process systems due to their high temperature, corrosiveness and noxious gas emissions.

SUMMARY OF THE INVENTION

The aim of the present invention is to provide a hydraulic device to be interposed in ducts for the passage of molten metal that allows to pump a chosen quantity of metal and/or control the flow of said metal.

Within this aim, an object of the invention is to provide a device that is suitable for metals of various kinds.

Another object is to provide a device that has a simple structure.

Another object is to provide a device that can be manufactured with known systems and technologies.

This aim and these and other objects that will become better apparent hereinafter are achieved by a hydraulic device for pumping molten metal and/or controlling flow thereof, characterized in that it comprises an enclosure that forms internally a cylindrical chamber, for the connection of at least one first and one second duct for the passage of molten metal, within which a piston can slide hermetically in order to pump and/or control flow, an insulating cushion of inert gas being interposed between said piston and the molten metal, said piston being associated with piston movement means for actuating movement thereof with a reciprocating rectilinear motion.

BRIEF DESCRIPTION OF THE DRAWINGS

Further characteristics and advantages of the invention will become better apparent from the description of a preferred but not exclusive embodiment thereof, illustrated only by way of non-limitative example in the accompanying drawings, wherein.

DESCRIPTION OF THE PREFERRED EMBODIMENTS

Figure 1:
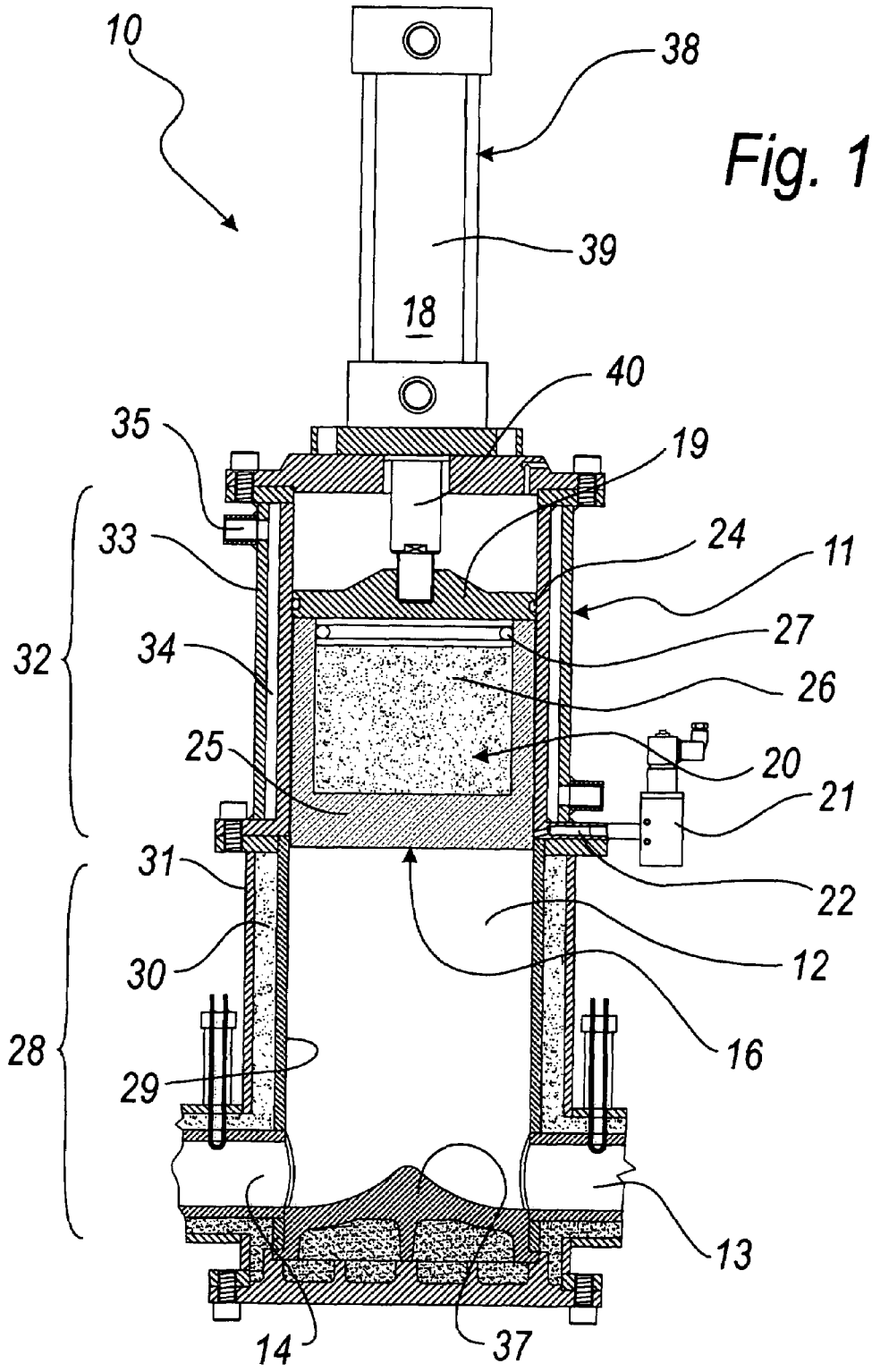
FIG. 1 is a view of a device according to the invention for pumping molten metal.
Figure 2:
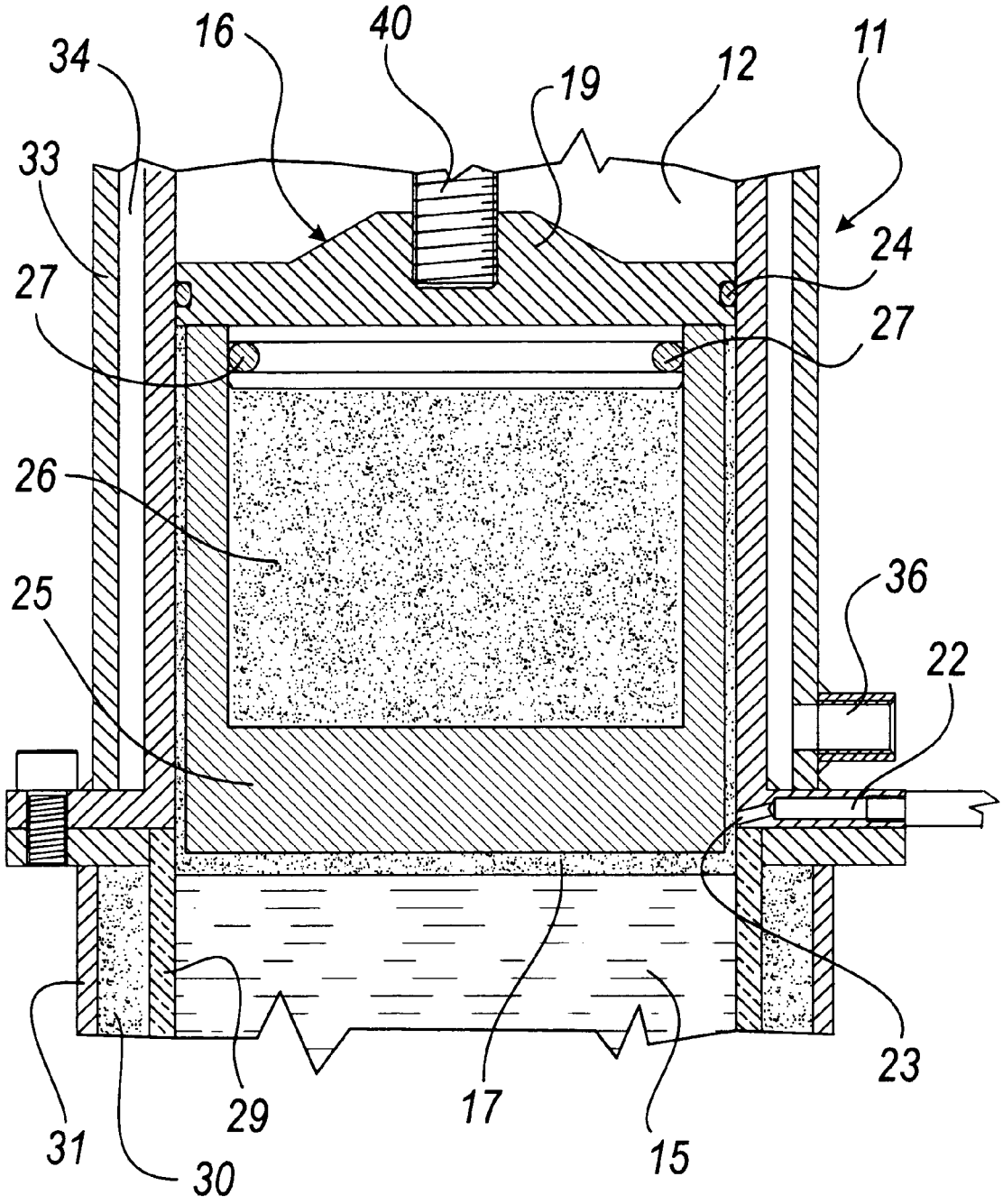
FIG. 2 is an enlarged-scale view of a detail of the device of FIG. 1.

With reference to the figures, a hydraulic device for pumping molten metal according to the invention is generally designated by the reference numeral 10.

The device comprises an enclosure 11, which forms internally a cylindrical chamber 12 for the connection of at least one first duct 13 and one second duct 14 for the passage of molten metal 15, within which a piston 16 can slide hermetically.

An insulating cushion 17 of inert gas, suitable to keep the metal 15 and the piston 16 separate, is interposed between the piston 16 and the molten metal 15.

The piston 16 is associated with means 18 for moving it with a reciprocating rectilinear motion, as better described hereinafter.

The piston 16 is constituted by a substantially disk-like portion 19, which can slide hermetically within the cylindrical chamber 12, and by a substantially cylindrical portion 20 whose diametrical dimension is smaller than the corresponding dimension of the cylindrical chamber 12, in order to form a tubular interspace in which the inert gas is present so as to form a cup-shaped insulating cushion 17.

The pressure and volume of the gas that forms the insulating cushion 17 are controlled by means of an electric valve 21, which controls the inflow of gas into the cylindrical chamber 12 through a radial duct 22 formed in the enclosure 11.

The radial duct 22 has an outlet 23 that leads inside the cylindrical chamber 12 and is arranged in a region in which it is always connected to the insulating cushion 17 even during the movement of the piston 16, which never makes contact with the metal 15.

A gasket 24 for forming a seal with the cylindrical chamber 12 is arranged perimetrically with respect to the disk-like portion 19.

The cylindrical portion 20 is provided with an outer shell 25, which is substantially cup-shaped and is made of ceramic material; said shell is filled with insulating putty 26, such as for example the putty known commercially by the trade-name INSURAL, and is fixed to the disk-like portion 19 by way of transverse pins 27.

The enclosure 11 comprises a first portion 28, which normally contains the metal 15 and is constituted by an inner layer 29 made of ceramic material, by an intermediate layer 30 made of insulating putty, such as for example the putty known commercially by the trade-name INSURAL, and by an outer layer 31 made of steel; and a second portion 32, which never contains metal 15 but inside which the piston 16 can slide; said second portion is provided with an outer jacket 33 that is suitable to form an interspace 34 in which a cooling liquid can flow through inlet and outlet connectors 35 and 36.

The enclosure 11 is to be arranged so that the cylindrical chamber 12 has a vertical axis and the first portion 28 is arranged below the second portion 32.

The first and second ducts 13 and 14 are connected at a bottom 37 of the first portion 28; at least one of said ducts has an intake function and at least one has a delivery function.

The embodiment described above for the enclosure 11 and the piston 16 is particularly suitable if the molten metal 15 is aluminum, which is a highly aggressive metal.

In the case instead, for example, of non-aggressive metals or alloys, the piston 16 and the enclosure 11 can be made of stainless steel.

The means for moving the piston 16 are constituted, in this case, by a linear actuator 38 with a body 39 that is fixed above the second portion 32 and with a head of the stem 40 that is fixed to the disk-like portion 19, on the opposite side with respect to the cylindrical portion 20.

The linear actuator 38 can be of the hydraulic type and can be managed by an electronic control unit for controlling the advancement of the piston 16 so as to control accordingly, by knowing the geometric parameters, the quantity of pumped or drawn molten metal.

Figure 3:
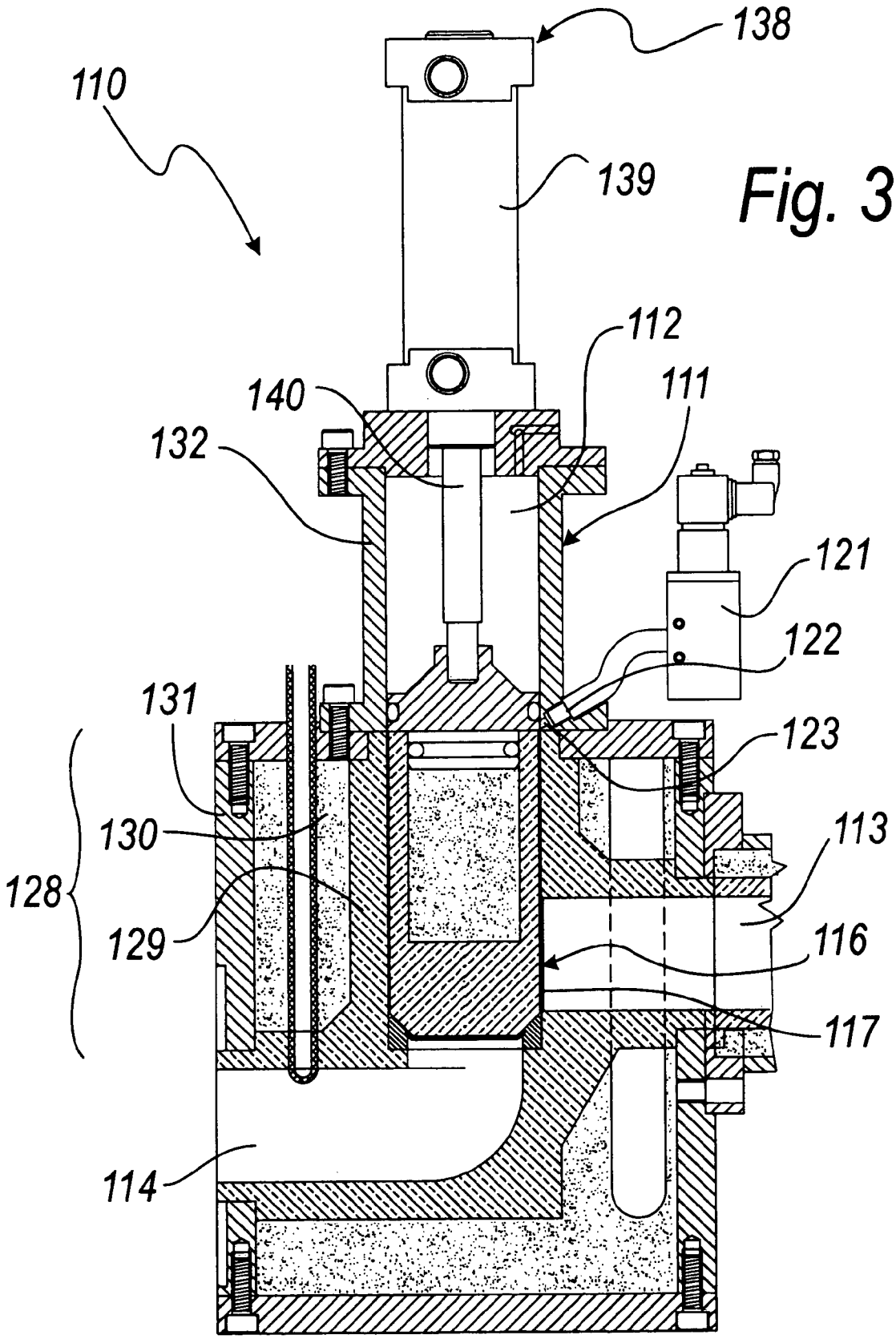
FIG. 3 is a view of the device according to the invention for controlling the flow of molten metal.

FIG. 3 illustrates a device 110, according to the invention, for controlling the flow of molten metal.

The device 110 has a simplified structure with respect to the device 10 and comprises an enclosure 111 that forms internally a cylindrical chamber 112, for the connection of a first duct 113 and a second duct 114, within which a piston 116 can slide hermetically.

The piston 116 is structurally similar to the piston 16 of the device 10, forming a cup-shaped insulating gas cushion 117.

In this case also, the pressure and volume of the gas that constitutes the insulating cushion 117 are controlled by an electric valve 121 that controls the inflow of the gas through a radial duct 122 with an outlet 123 arranged in such a region that it is always in contact with the cushion 117.

The enclosure 111 is constituted by a first portion 128, which is constituted by an inner layer 129 made of ceramic material, an intermediate layer 130 made of insulating putty, and an outer layer 131 made of steel.

The second portion 132 in which the piston 116 can slide is a tubular steel body.

In this case also, the embodiment shown for the enclosure 111 and the piston 116 is particularly suitable if the molten metal 15 is aluminum, which is a highly aggressive metal.

As mentioned, the first and second ducts 113 and 114 are connected to the first portion 128 and are arranged in this case so that their longitudinal axes are parallel at different heights.

The piston 116 is associated with a linear actuator 138, which has a body 139 that is fixed above the second portion 132 of the enclosure 111 and a head of the stem 140 that is fixed to the disk-like portion 119 of the piston 116 on the opposite side with respect to the cylindrical portion 120.

In this case, the linear actuator 138 is of the pneumatically-actuated type, since stroke limit control is sufficient to affect the flow of the molten metal 15, blocking said first and second ducts.

Figure 4:
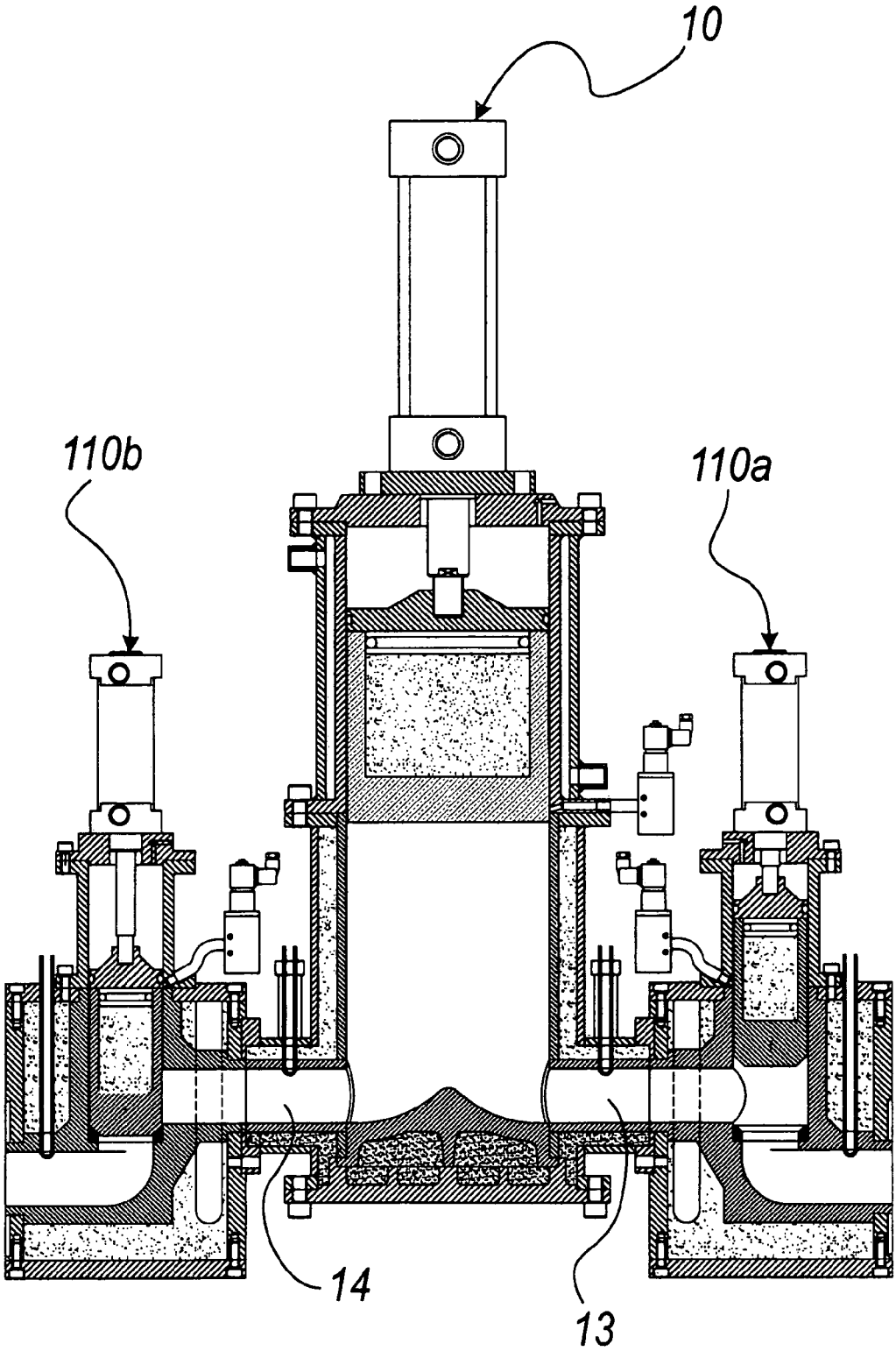
FIG. 4 is a view of a composite apparatus comprising a plurality of devices according to the invention.

Advantageously, it is possible to combine a device 10 for pumping molten metal with two devices 110*a* and 110*b* for controlling the flow of the molten metal as shown in FIG. 4.

In particular, upstream of the first duct 13 there is a first flow control device 110*a*, while downstream of the second duct 14 there is a second flow control device 110*b*.

By alternately actuating the closure and opening of the flow control devices 110*a* and 110*b*, it is possible to control the intake and delivery of the pumping device 10 from the first and second ducts 13 and 14.

In practice it has been found that the present invention has achieved the intended aim and objects.

The device according to the invention has a structure which makes it possible to control the quantity of molten metal pumped into the ducts.

The high temperature of the molten metal would not allow to use minimal plays between the piston and the cylindrical chamber within which it slides.

The inert gas cushion prevents the molten metal from seeping into the clearances between the piston and the cylindrical chamber and hindering in any way the movement of the piston.

Moreover, the play is such that the structure is not affected by the expansions of the material caused by the high operating temperatures.

Furthermore, by controlling the pressure and the volume of the gas of the cushion by way of the electric valve, it is possible to give the device high flexibility with regard to the materials used and to the pressures applied.

The present invention is susceptible of numerous modifications and variations, all of which are within the scope of the appended claims.

The technical details may be replaced with other technically equivalent elements.

The materials, so long as they are compatible with the contingent use, as well as the dimensions, may be any according to requirements.

The disclosures in Italian Patent Application No. PD2001A000302 from which this application claims priority are incorporated herein by reference.

What is claimed is:

1. A hydraulic device for pumping molten metal and/or controlling flow thereof, comprising an enclosure that forms internally a cylindrical chamber, for the connection of at least one first duct and one second duct for the passage of molten metal, within which a piston can slide hermetically in order to pump and/or control flow, an insulating cushion of inert gas being interposed between said piston and the molten metal, said piston being associated with piston movement means for actuating movement thereof with a reciprocating rectilinear motion, said piston comprising a substantially disk portion, which forms a seal with said cylindrical chamber, and a substantially cylindrical portion whose diametrical dimension is smaller than that of said cylindrical chamber in order to form an interspace comprising inert gas that forms a cup-shaped insulating cushion, said substantially cylindrical portion comprising an outer shell that is substantially cup-shaped, is made of ceramic material, is filled with insulating putty, and is fixed to said substantially disk portion.

2. The device of claim 1, wherein said substantially cylindrical portion is fixed to said substantially disk portion by way of transverse pins.

3. A hydraulic device for pumping molten metal and/or controlling flow thereof, comprising an enclosure that forms internally a cylindrical chamber, for the connection of at least one first duct and one second duct for the passage of molten metal, within which a piston can slide hermetically in order to pump and/or control flow, an insulating cushion of inert gas being interposed between said piston and the molten metal, said piston being associated with piston movement means for actuating movement thereof with a reciprocating rectilinear motion, said enclosure comprising a first portion within which the molten metal is normally present, said portion being constituted by an inner layer made of ceramic material, an intermediate layer made of insulating putty, and an outer layer made of steel.

4. The device of claim 3, wherein said enclosure comprises a second portion, within which said piston slides, said second portion being provided with an outer jacket that forms an interspace in which a cooling liquid flows.

* * * * *